US012378762B1

(12) United States Patent
Moore

(10) Patent No.: US 12,378,762 B1
(45) Date of Patent: Aug. 5, 2025

(54) MODULAR BATHROOM CONSTRUCTION AND INSTALLATION METHOD

(71) Applicant: Joe M Moore, Mobile, AL (US)

(72) Inventor: Joe M Moore, Mobile, AL (US)

( * ) Notice: Subject to any disclaimer, the term of this patent is extended or adjusted under 35 U.S.C. 154(b) by 325 days.

(21) Appl. No.: 18/205,101

(22) Filed: Jun. 2, 2023

Related U.S. Application Data

(63) Continuation-in-part of application No. 17/005,268, filed on Aug. 27, 2020, now abandoned.

(51) Int. Cl.
*E04B 1/348* (2006.01)
*A47K 4/00* (2006.01)

(52) U.S. Cl.
CPC ..... *E04B 1/34869* (2013.01); *E04B 1/34815* (2013.01); *A47K 4/00* (2013.01)

(58) Field of Classification Search
CPC .. E04B 1/343; E04B 1/34315; E04B 1/34352; E04B 1/34869; E04B 1/3522; E04B 2001/3577; E04B 2001/3588
USPC ..... 52/745.02
See application file for complete search history.

(56) References Cited

U.S. PATENT DOCUMENTS 1,404,613 A * 1/1922 Hormes ..... E04H 3/02 52/33
2,484,412 A * 10/1949 Keel ..... G09B 29/00 355/77
2,545,409 A * 3/1951 Mccall ..... G09B 25/04 33/1 G
2,610,413 A * 9/1952 Dasey ..... G09B 29/00 D10/61
3,442,056 A * 5/1969 Van Der Lely et al. ..... E04C 2/384 52/236.7
3,659,353 A * 5/1972 D'Agrosa ..... G09B 25/04 434/73
3,664,082 A * 5/1972 Zintel ..... E04G 21/14 52/741.15
3,807,105 A * 4/1974 Rudkin, Jr. ..... E04B 1/34815 52/80.1

(Continued)

FOREIGN PATENT DOCUMENTS

WO WO-02097206 A1 * 12/2002 ..... E04B 1/34807
WO WO-2016046770 A1 * 3/2016 ..... E04B 1/3404

*Primary Examiner* — Brian D Mattei
*Assistant Examiner* — Joseph J. Sadlon
(74) *Attorney, Agent, or Firm* — Golf Coast Intellectual Property Group

(57) ABSTRACT

A modular bathroom that is constructed at a first location and transported to a second location wherein the modular bathroom is configured to operably couple to an existing structure at the second location and wherein the modular bathroom is designed to accommodate physically challenged individuals. The method of the present invention provides a technique to construct the modular bathroom at a first location. The modular bathroom includes releasably secured transportation elements such as but not limited to a wheel axle member and a lifting member. A layout template is provided in order to assist and ensure the proper preparation of the second location prior to the delivery of the modular bathroom. The modular bathroom is delivered to the second location and elevated if necessary so as to align the floor thereof with the floor of the existing structure. The transportation elements are removed after installation for re-use.

20 Claims, 9 Drawing Sheets

(56) References Cited

U.S. PATENT DOCUMENTS 3,862,534 A * 1/1975 Coletti ..... E04B 1/34869 52/234
3,940,890 A * 3/1976 Postlethwaite ..... E04B 1/34815 52/263
4,320,607 A * 3/1982 Eubank ..... B66F 3/46 52/223.6
4,345,381 A * 8/1982 Brislin ..... E05B 17/06 33/528
4,364,206 A * 12/1982 Wybauw ..... E04B 1/3483 52/79.9
4,381,629 A * 5/1983 Ahn ..... A01G 9/16 135/92
4,519,176 A * 5/1985 Britz ..... E04H 1/02 52/741.11
5,459,966 A * 10/1995 Suarez ..... A47K 4/00 52/309.1
5,692,357 A * 12/1997 McCain ..... E04F 21/0076 33/528
5,706,615 A * 1/1998 Bridges ..... B28B 7/22 52/406.2
5,735,094 A * 4/1998 Zember ..... E04F 21/04 427/403
6,035,590 A * 3/2000 Lindsay ..... E04B 1/34336 280/789
6,074,211 A * 6/2000 Reid ..... G09B 19/00 434/81
6,880,299 B2 * 4/2005 Martin ..... E04C 2/043 52/745.19
7,421,796 B1 * 9/2008 DeAngelis-Morris ..... A47G 1/205 33/1 G
7,735,265 B2 * 6/2010 Tinker ..... E04B 1/3211 52/2.21
8,151,537 B2 * 4/2012 Pope ..... E04B 1/3431 52/741.1
8,407,964 B1 * 4/2013 Roy ..... E04B 1/161 52/294
8,533,927 B2 * 9/2013 Atherton ..... G09B 25/04 33/562
8,978,324 B2 * 3/2015 Collins ..... E04C 2/521 52/404.1
9,060,652 B2 * 6/2015 Bikker ..... E04H 1/1216
9,068,343 B2 * 6/2015 Commerford ..... B32B 7/06
9,512,593 B2 * 12/2016 Drummond ..... E04B 1/41
9,655,309 B1 * 5/2017 Hall ..... A01G 9/16
9,747,811 B2 * 8/2017 Blackburn ..... G09B 9/00
9,840,837 B1 * 12/2017 Matsuoka ..... E04B 1/19
10,017,951 B2 * 7/2018 Youngborg ..... E04B 2/58
10,240,339 B1 * 3/2019 Dominguez ..... E04B 1/34869
10,400,439 B2 * 9/2019 Lim ..... E04B 1/3483
10,450,739 B1 * 10/2019 Schlagel ..... E04H 1/04
10,858,817 B2 * 12/2020 Wong ..... E04B 1/34823
10,883,264 B1 * 1/2021 Wee ..... B29C 41/06
11,222,147 B2 * 1/2022 Pinho ..... G06F 30/13
2003/0140571 A1 * 7/2003 Muha ..... A47K 4/00 52/36.2
2003/0140572 A1 * 7/2003 Hertzog ..... E04F 13/0853 52/220.8
2007/0163184 A1 * 7/2007 Olesch ..... E04B 1/34838 52/79.5
2007/0294954 A1 * 12/2007 Barrett ..... E04H 1/125 52/36.2
2007/0294957 A1 * 12/2007 Schwenker ..... B60S 13/02 104/44
2008/0086976 A1 * 4/2008 Gilgan ..... E04B 1/35 52/745.04
2008/0111327 A1 * 5/2008 Rhodes ..... E04G 21/161 414/679
2009/0100769 A1 * 4/2009 Barrett ..... E04B 1/34869 52/745.13
2012/0291362 A1 * 11/2012 Milo ..... E04H 15/20 52/2.21
2013/0061483 A1 * 3/2013 Wynn ..... B43L 12/00 33/566
2013/0086849 A1 * 4/2013 Clouser ..... E04H 1/00 52/79.9
2013/0192147 A1 * 8/2013 Schaffert ..... E04B 1/344 52/79.5
2013/0305629 A1 * 11/2013 Stephenson ..... E04H 1/005 52/79.9
2014/0150352 A1 * 6/2014 Lee ..... E04B 1/3444 52/79.5
2015/0267425 A1 * 9/2015 Harlow ..... E04H 1/1277 52/741.1
2016/0222645 A1 * 8/2016 Fay ..... E04B 7/12
2017/0370116 A1 * 12/2017 Cincotta ..... B60P 3/32
2018/0023309 A1 * 1/2018 Brawner ..... E04H 1/1205 52/745.06
2018/0165417 A1 * 6/2018 Hall ..... A61B 5/6891
2019/0234063 A1 * 8/2019 Garcia-Abril Ruiz .. E04F 17/08
2021/0010256 A1 * 1/2021 Edvall Nicevski ..... E04C 3/16
2021/0324644 A1 * 10/2021 Dicks ..... E04H 1/02

* cited by examiner

MODULAR BATHROOM CONSTRUCTION AND INSTALLATION METHOD

CROSS REFERENCE TO RELATED APPLICATIONS

This application is a continuation-in-part of U.S. patent application Ser. No. 17/005,268 filed, Aug. 27, 2020, entitled, Modular Bathroom Construction and Installation Method, in the name of Joe M. Moore, which is hereby incorporated for reference.

FIELD OF THE INVENTION

The present invention relates generally to modular buildings, more specifically but not by way of limitation, a modular bathroom configured to be operably coupled to an existing structure wherein the modular bathroom provides accessibility for individuals with physical limitations and wherein the present invention further includes a transportation and installation method.

BACKGROUND

As is known in the art, those individuals that have physical challenges or limitations require living accommodations that have unique characteristics that both allow independent living as well as safety. Some modifications to a home can be simple such as ramp entries to accommodate wheelchairs while other modifications require significant remodeling of a conventional home. One area of the home that requires significant remodeling is the bathroom. Bathroom accidents are a leading cause of injury to physically challenged individuals and as such the requirements to ensure safety of an individual in a bathroom are numerous.

Typically when a bathroom requires reconfiguration and or remodeling to accommodate a physically challenged person the remodel can typically take months with delays being common due to permitting and/or routine construction delays. Additionally, some homes have bathrooms that require additional remodeling in areas that provide access to the bathroom in order to provide the necessary entry into the bathroom. These types of modifications can be items such as but not limited to step removal. Furthermore, some multi-story home do not have full bathrooms on the ground floor and as such this would require much more major renovations to the home.

It is intended within the scope of the present invention to provide a modular bathroom and installation method wherein the method of the present invention provides a completely built bathroom that is operably coupled to an existing structure wherein the bathroom provides accommodation for the physically challenged.

SUMMARY OF THE INVENTION

It is the object of the present invention to provide a modular building that is configured to be transported and coupled to an existing structure wherein the modular building is a bathroom.

Another object of the present invention is to provide a modular bathroom constructed independently and configured to be transported and installed adjacent an existing structure wherein the present invention can be installed adjacent to an elevated existing structure.

A further object of the present invention is to provide a modular building that is configured to be transported and coupled to an existing structure wherein the present invention provides accessible features for individuals that have physical limitations.

Still another object of the present invention is to provide a modular bathroom constructed independently and configured to be transported and installed on an existing structure wherein the present invention includes a full size pattern layout to be utilized at the installation site prior to arrival of the modular bathroom.

An additional object of the present invention is to provide a modular building that is configured to be transported and coupled to an existing structure wherein the present invention includes a trailer system with leveling members utilized for installation.

Yet a further object of the present invention is to provide a modular bathroom constructed independently and configured to be transported and installed on an existing structure wherein the full size pattern layout identifies locations for elements such as but not limited to drain pipes and utility connections.

Another object of the present invention is to provide a modular building that is configured to be transported and coupled to an existing structure wherein a step of the method of the present invention includes providing a axle base to the floor of the modular bathroom.

An alternate object of the present invention is to provide a modular bathroom constructed independently and configured to be transported and installed on an existing structure wherein the present invention further includes the step of mating the modular bathroom to a door way frame on the existing structure.

Still a further object of the present invention is to provide a modular building that is configured to be transported and coupled to an existing structure wherein the present invention includes a step of leveling a portion of the area where the modular bathroom will be placed.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
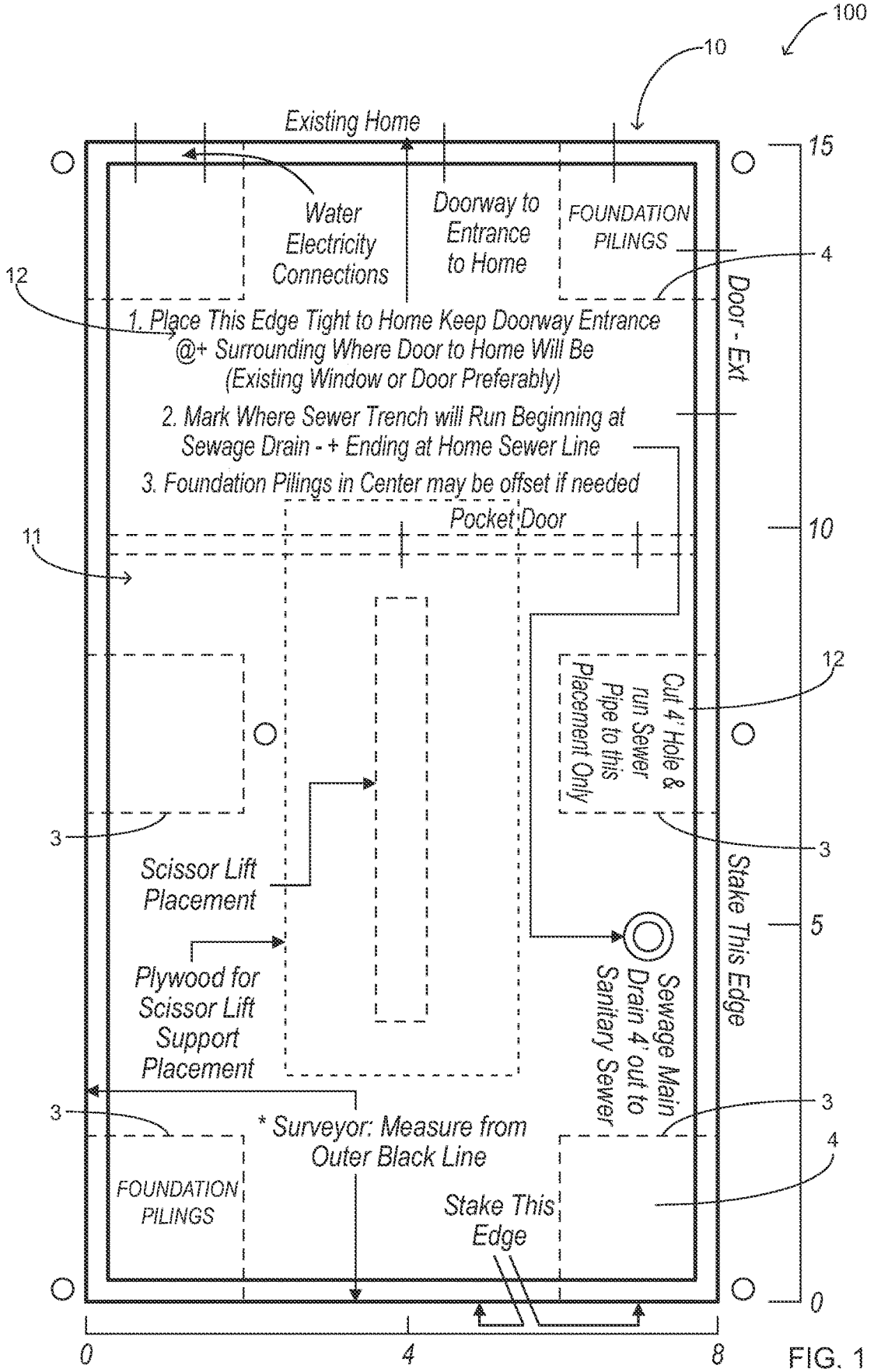
FIG. 1 is a schematic view of the full size pattern layout of the present invention.

References now to the drawings submitted herewith, wherein various elements depicted therein are not necessarily drawn to scale and wherein through the views and figures like elements are referenced with identical reference numerals, there is illustrated a modular bathroom construction and installation method 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Figures submitted as a part hereof, the modular bathroom construction and installation method 100 includes a structure 5 wherein in the preferred embodiment of the present invention is a modular bathroom. While a modular bathroom is the preferred embodiment of the structure 5 of the present invention, it should be understood within the scope of the present invention that the structure 5 could be designed and purposed for alternate uses. As will be described herein, the structure 5 of the present invention is completely constructed off site from the location of the exemplary building 99 to which the structure 5 is operably coupled. While a fifteen foot by eight foot size is a preferred size for the structure 5 as indicated by the layout template 10, it should be understood within the scope of the present invention that the structure 5 could be provided in alternate sizes.

Figure 5:
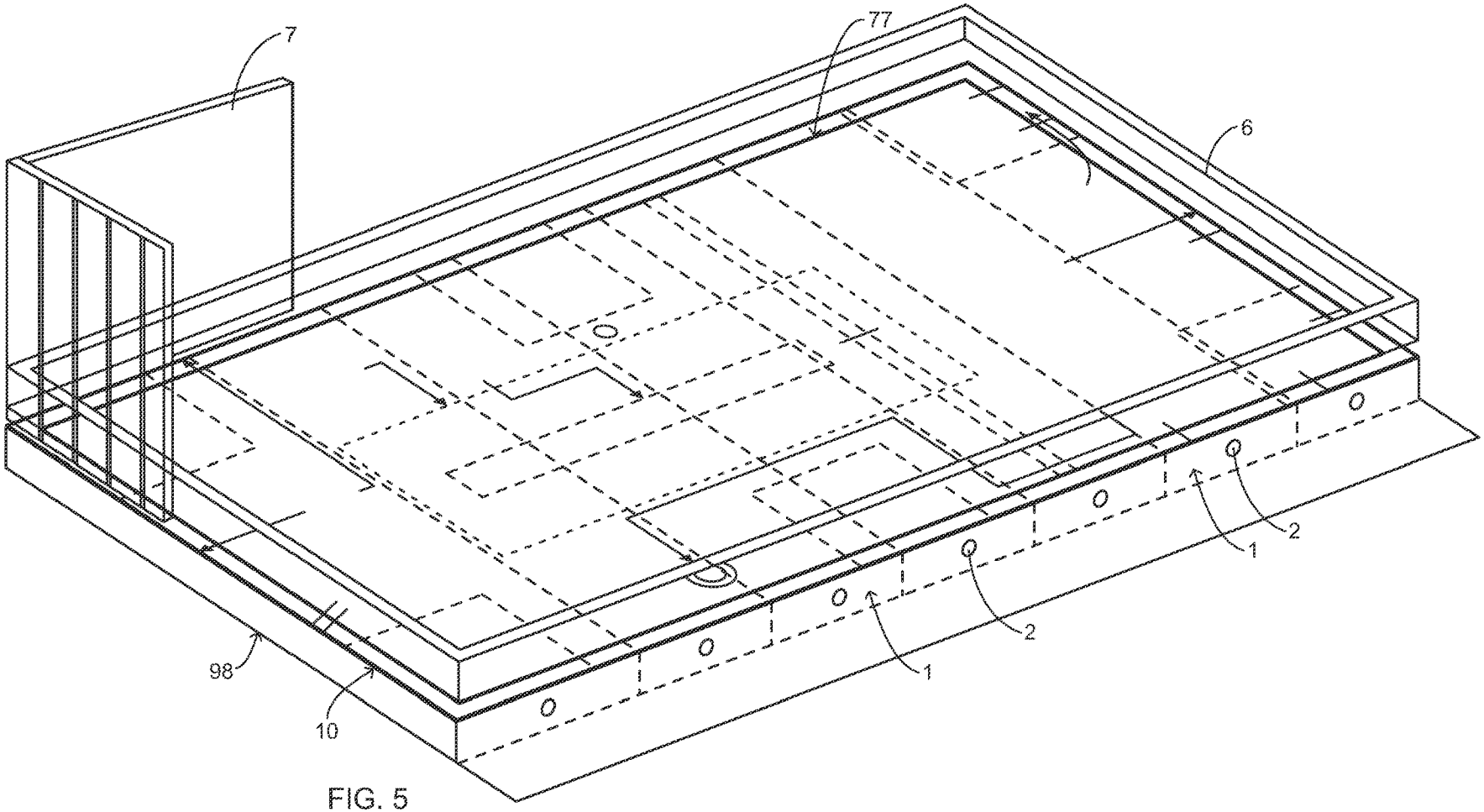
FIG. 5 is a perspective view of the layout template subsequent inflation adjacent a frame to be secured thereto.

Referring in particular to FIG. 1 and FIG. 5, the layout template 10 of the present invention is illustrated therein. The layout template 10 is provided to an entity that will be responsible for the installation of the structure 5 adjacent to the exemplary building 99. The layout template 10 is planar in manner and manufactured from a material such as but not limited to plastic. It is intended within the scope of the layout template 10 is foldable and/or rollable so as to facilitate storage for transport thereof. The layout template 10 has imprinted on the upper surface 11 thereof a plurality of indicia instructions 12. The indicia instructions 12 are provided to offer guidance and/or specific instructions as it related to the positioning of the layout template 10 as well as the installation preparation for the structure 5. It should be understood that the indicia instructions 12 illustrated herein are exemplary only and that alternate and/or additional indicia instructions 12 could be provided on the upper surface 11 of the upper layer 77 of the layout template 10. The intention of the layout template 10 is to provide an exact size template of the structure 10 so as to avoid any potential survey or other common preparation errors such as but not limited to misplacement of plumbing lines.

The layout template 10 as illustrated herein in FIG. 5 is configured to be inflated subsequent to placement thereof. The layout template 10 is manufactured from a material such as but not limited to a heavy duty plastic and includes a plurality of inflation valves 2. The inflation valves 2 are configured to facilitate introduction of a spray foam or similar material into the chambers 1 of the layout template 10. The layout template 10 includes a plurality of chambers 1 that are defined by seams 3 wherein these chambers 1 provide an ability to inflate the layout template 10 separating the lower layer 98 and upper layer 77 so as to fill therebetween with spray foam or other suitable material. Ensuing placement of the layout template 10 the inflation valves 2 are operably coupled to an insulation source (not illustrated herein) wherein the layout template 10 is inflated and as such expands with a foam insulation that is deposited into the interior volume thereof. Lines 3 illustrated herein represent seams in the layout template 10 wherein the seams are configured to allow placement of items such as but not limited to foundation pilings through openings 4 defined thereby without comprising the structural integrity of the inflatable layout template 10. The layout template 10 is bordered by an outer frame 6 wherein the outer frame 6 circumferentially surrounds the layout template 10. The outer frame 6 provides a bottom structure to mechanically fasten layout template 10 thereto utilizing suitable fasteners such as but not limited to staples. Additionally, the layout template 10 can be mechanically secured to the outer frame 6 ensuing completion of installation and inflation of the layout template 10. Inflation of the layout template 10 ensuing installation thereof provides additional insulation for structure 5 as well as provides a moisture barrier underneath the structure 5. Outer wall 7 can be subsequently coupled to frame 6.

Figure 4:
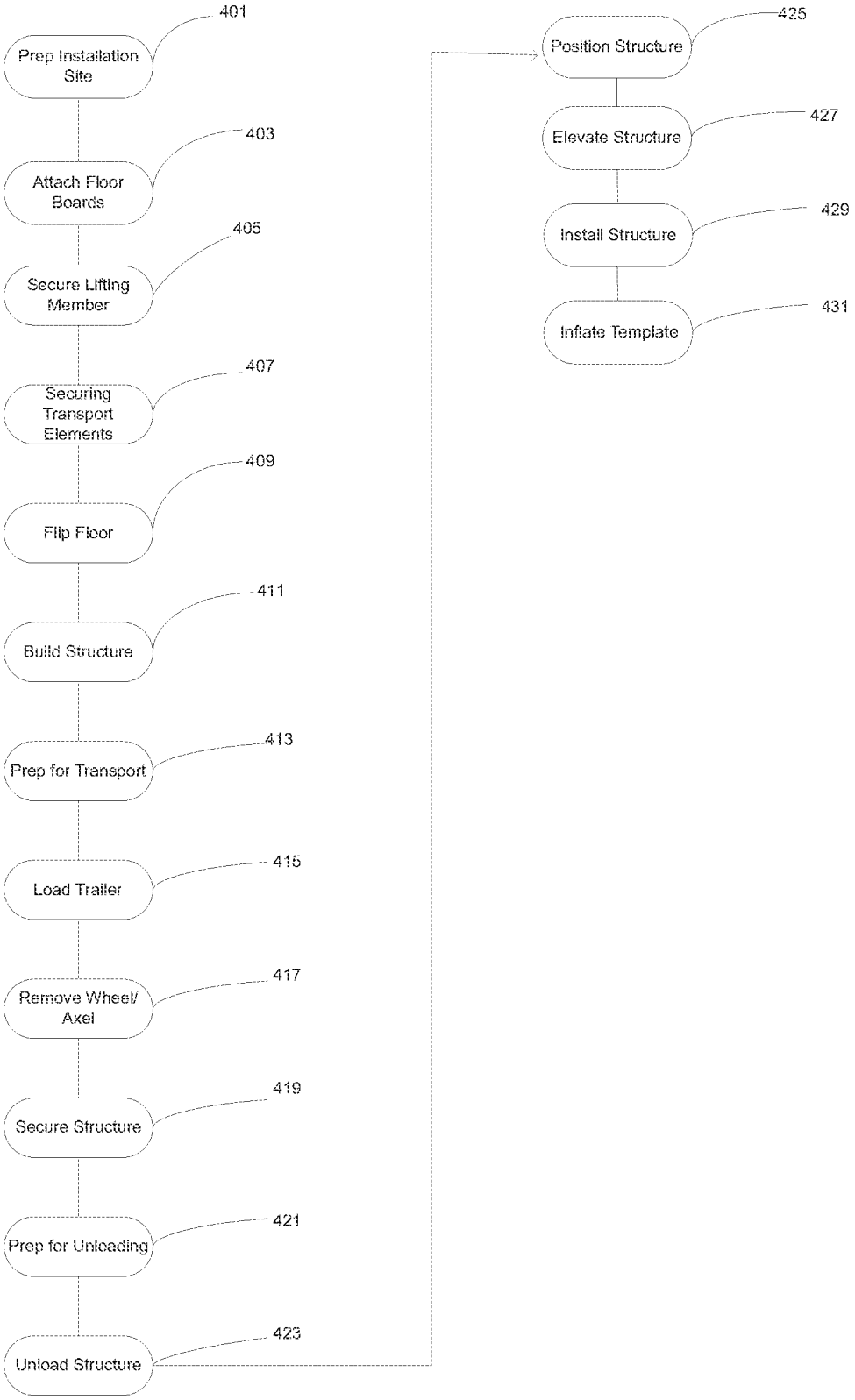
FIG. 4 is a flow chart of the process of the present invention.

Now referring to FIG. 4 herein, with further reference to FIGS. 2*a* through 2*m*, the method of the present invention is illustrated and discussed herein. In step 401, an entity responsible for installation of the structure 5 will execute a plurality of activities at the site wherein the installation of the structure 5 will occur. These activities can include but are not limited to: setting a door in the exemplary building, preparing electrical connections to facilitate electrical coupling of the structure 5 ensuing installation thereof, leveling a four foot by eight foot section of ground within the boundaries of the layout template wherein the leveled section of ground is optimal for engagement of the lifting member 95. Furthermore, additional desired procedures executed in step 401 include determining placement of utilities, installation of ground plates and preparation of a site plan that provides information on installation site terrain and an approach plan.

Figure 2A:
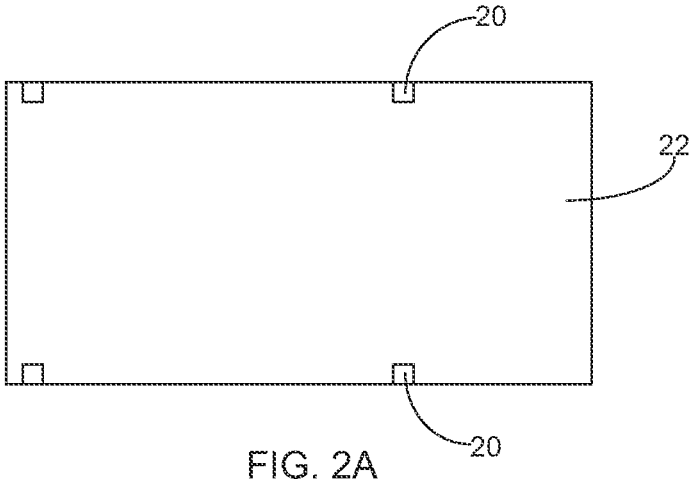
FIG. 2*a* is a schematic view of the floor of the structure of the present invention.
Figure 2B:
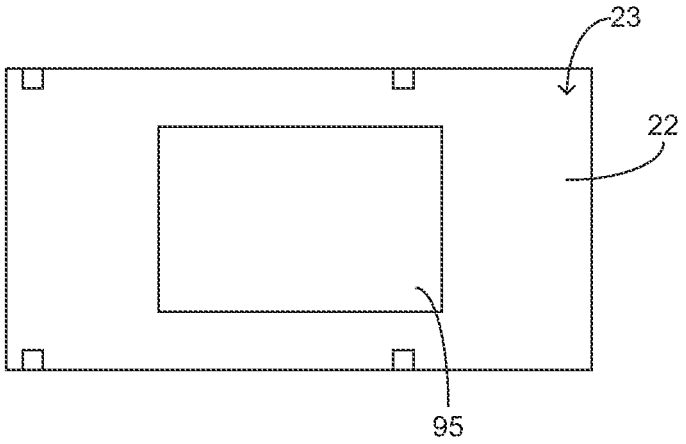
FIG. 2*b* is a schematic view of the bottom of the floor of the structure of the present invention.

In step 403, as is illustrated herein in FIG. 2*a*, a material such as but not limited to plywood is operably secured to floor support joists (not illustrated herein) wherein the configuration is compliant with all local building codes. Additionally, apertures 20 are formed in the floor 22 wherein the apertures 20 are placed in the necessary position to accommodate mounting posts 90 during installation of the structure 5. Step 405, a lifting member 95 is secured to the bottom surface 23 of the floor 22. The lifting member 95 is secured utilizing suitable durable techniques such as but not limited to mechanical fasteners. It should be understood within the scope of the present invention that the preferred embodiment of the lifting member 95 is a scissor lift. Furthermore, it is desired that the upper mounting plate of the lifting member 95 is approximately fifty percent of the floor 22 square footage. This ensures a stable engagement by the lifting member 95 during the installation process. As was previously discussed herein, the leveling of a portion of the ground as outlined on the layout template provides further assurance of a level and stable lifting of the structure 5 during the final installation process illustrated herein in FIG. 2*l*.

Figure 2C:
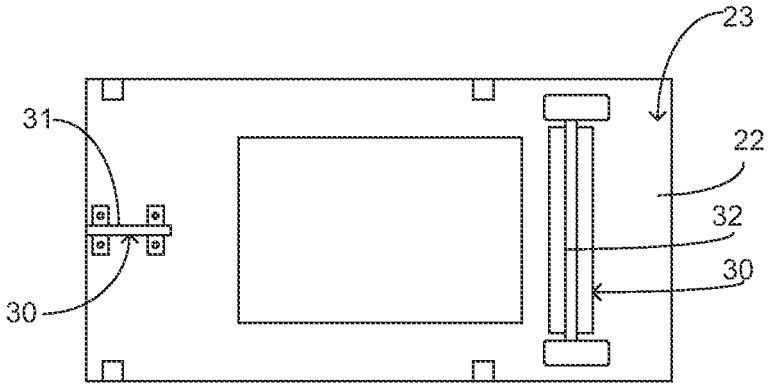
FIG. 2*c* is a schematic view of the bottom surface of the floor of the present invention having additional elements secured thereto.
Figure 2D:
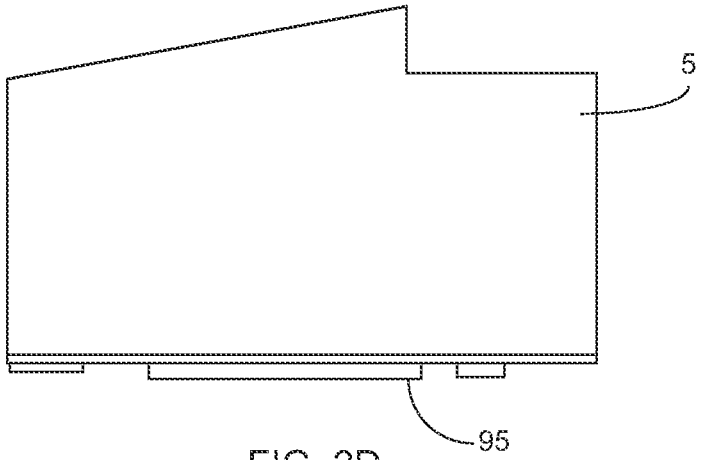
FIG. 2*d* is a side view of the structure of the present invention.

In step 407, a user will secure transport elements 30 to the bottom surface 23 of the floor 22 as illustrated herein in FIG. 2*c*. It is contemplated within a preferred embodiment of the present invention that a receiver tube 31 configured to couple to a trailer shank. A wheel axle member 32 is also installed. Step 409, the floor 22 will be flipped so as to provide access to the upper surface. In step 411, the structure 5 will be constructed on top of the floor 22 as illustrated herein in FIG. 2*d*. It should be understood within the scope of the present invention that the structure 5 is built in accordance with all local building codes and is compliant therewith. It should be understood that the structure 5 could be built utilizing suitable durable materials such as but not limited to wood and metal.

Figure 2E:
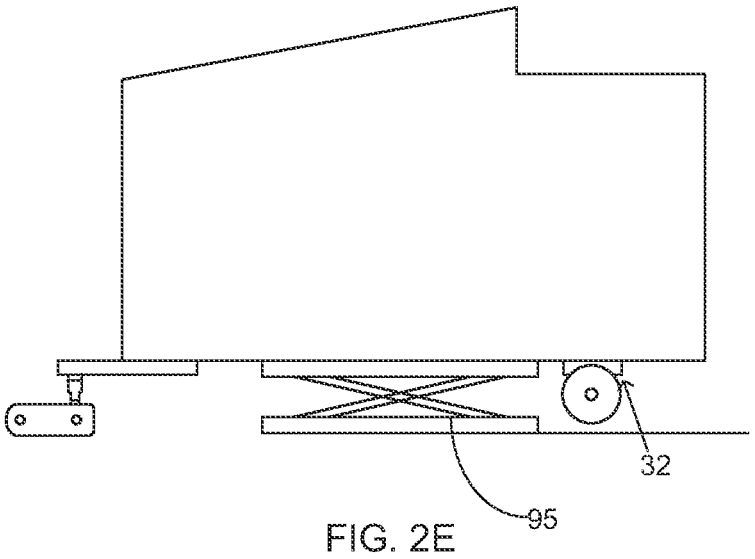
FIG. 2*e* is a side view of the structure of the present invention being positioned for loading onto a trailer.
Figure 2F:
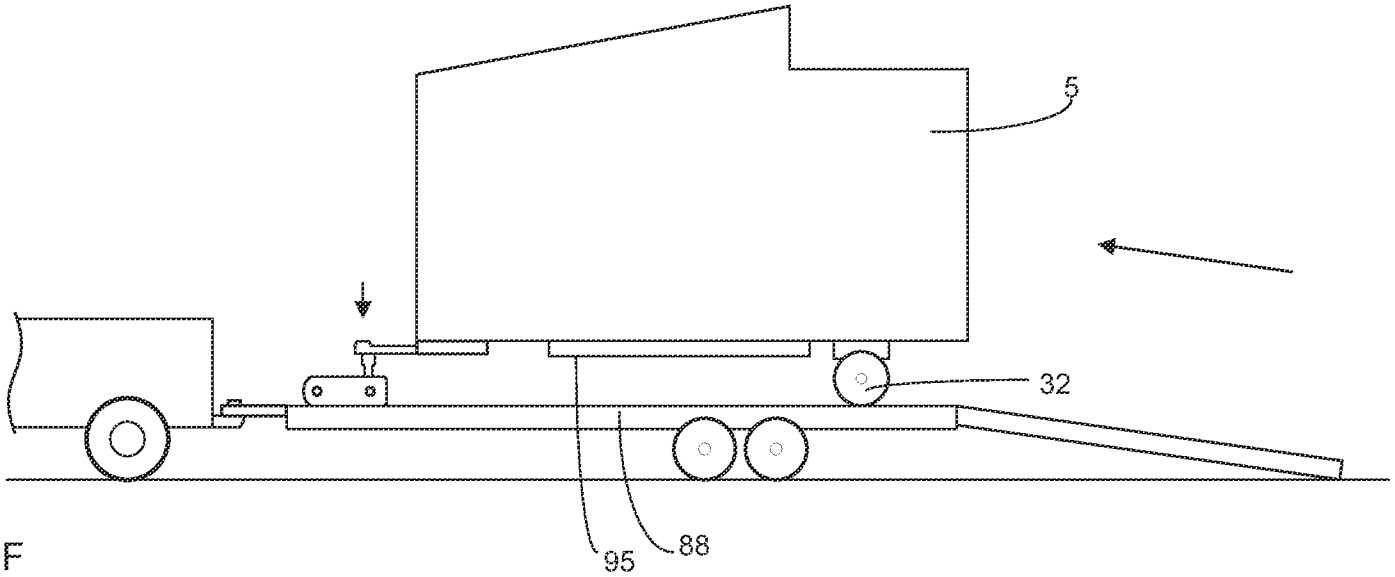
FIG. 2*f* is a side view of the structure of the present invention being loaded on a transport trailer.
Figure 2G:
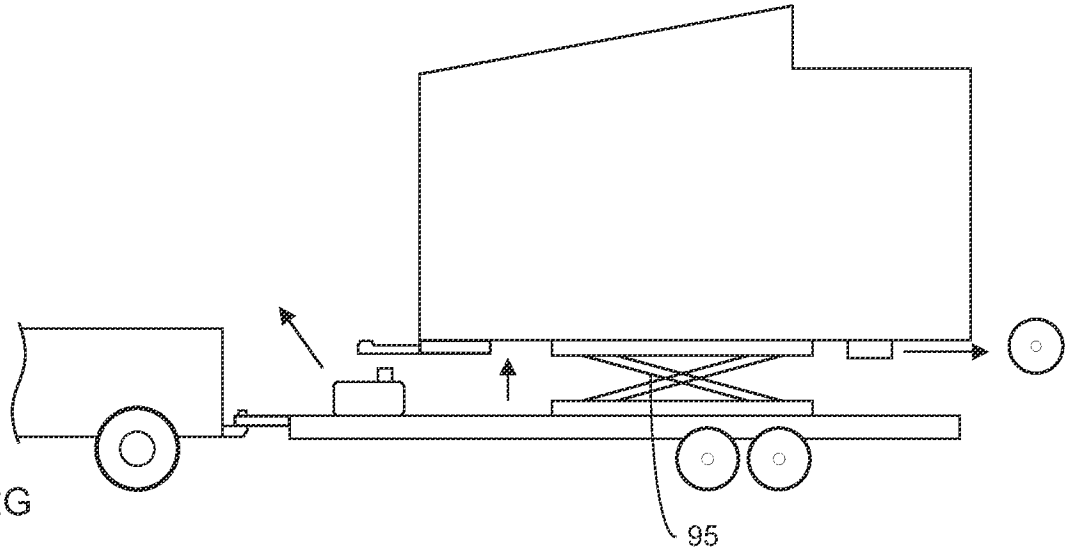
FIG. 2*g* is a side view of the structure of the present invention being prepared for securing to the transport trailer.
Figure 2H:
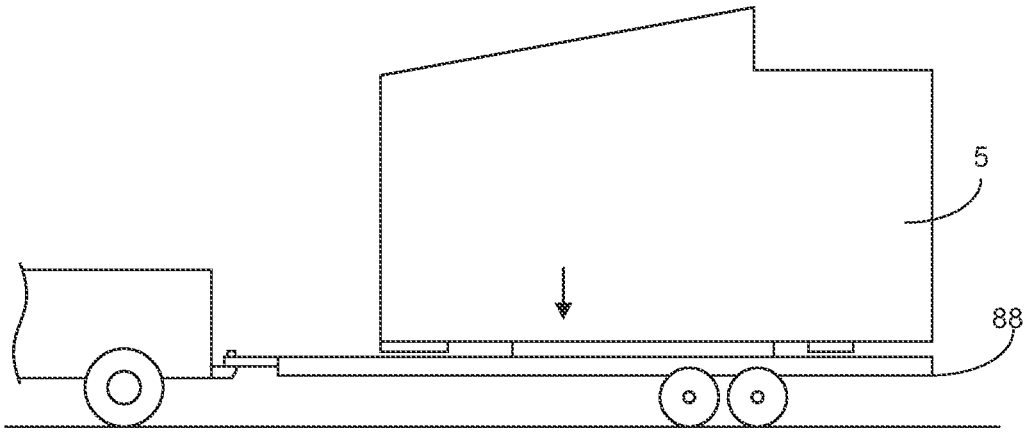
FIG. 2*h* is a side view of the structure of the present invention in a transportable position on the transport trailer.

Step 413, ensuing construction of the structure 5, the structure 5 is prepped to be loaded onto the transport trailer 88, as is illustrated herein in FIG. 2*e*. During this process the lifting member 95 is extended to allow re-installation of the wheel axle member 32 and the receiver tube 31 is operably coupled to a suitable trailer valet. In FIG. 2*f* herein, step 415 is illustrated therein wherein the structure 5 is traversed onto the transport trailer 88. In step 417, the lifting member 95 is utilized to facilitate the positioning of the structure 5 in order to remove the wheel axle member 32. Step 417 is illustrated herein in FIG. 2*g*. In step 419, as is illustrated herein in FIG. 2*h*, the lifting member 95 is lowered in order to place the structure 5 such that the structure 5 is superposed the transport trailer 88 and is secured thereto for transport.

Figure 2I:
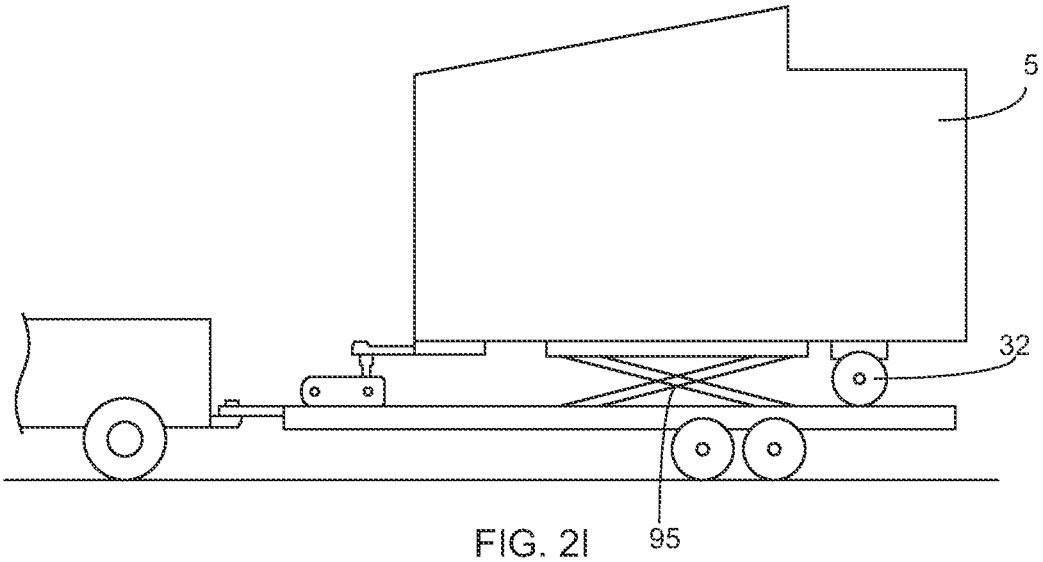
FIG. 2*i* is a side view of the structure of the present invention in a preparation position for removal from the transport trailer.
Figure 2J:
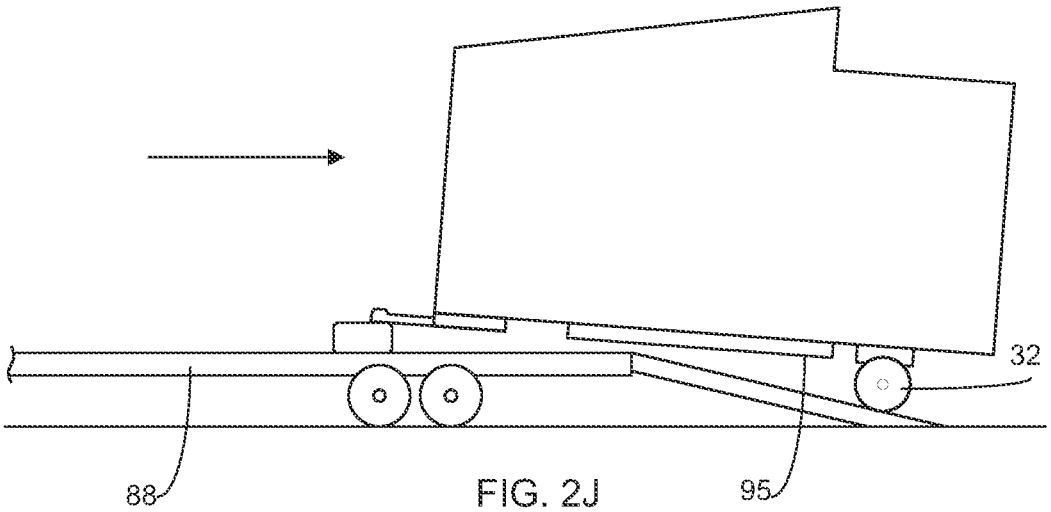
FIG. 2*j* is a side view of the structure of the present invention being removed from the transport trailer.
Figure 2K:
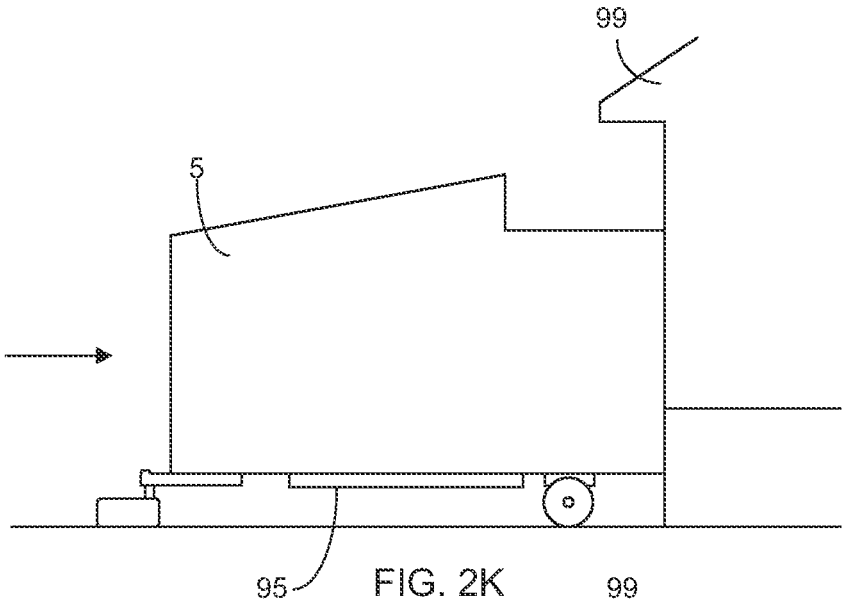
FIG. 2*k* is a side view of the structure of the present invention in an alignment position with a fixed building.
Figure 2L:
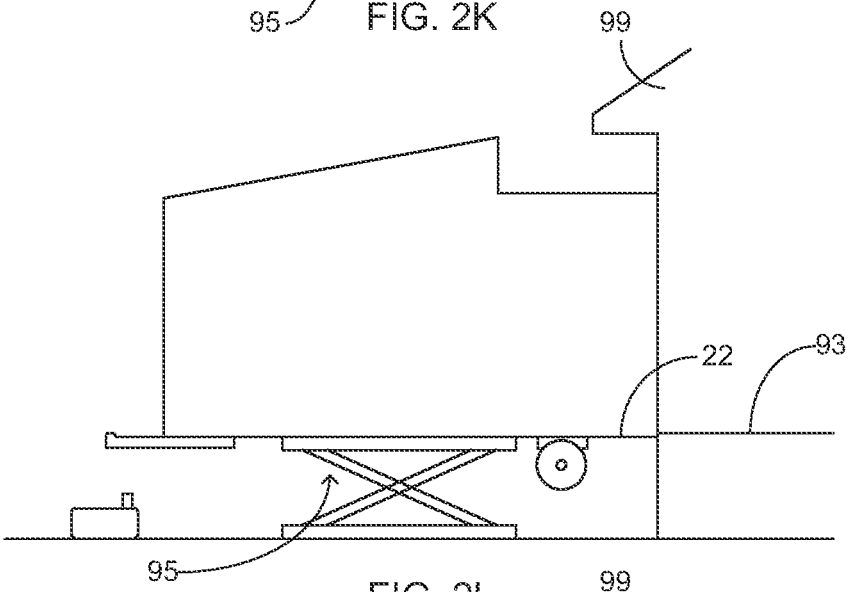
FIG. 2*l* is a side view of the structure of the present invention being moved to an elevated position.
Figure 2M:
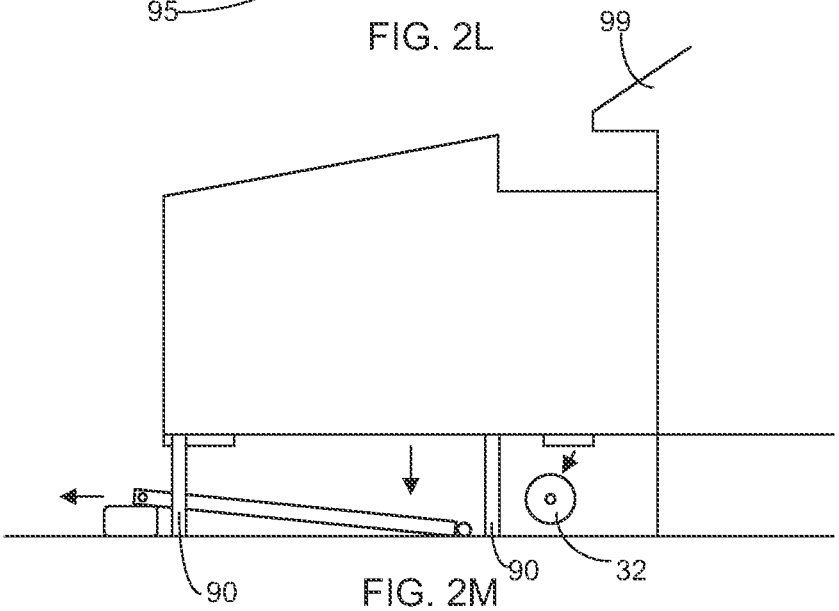
FIG. 2*m* is a side view of the structure of the present invention being moved to its installed position.

In step 421, as is illustrated herein in FIG. 2*i*, the structure 5 ensuing arrival proximate an installation location is prepared for unloading from the transport trailer 88. To achieve this the lifting member 95 is utilized to elevate the structure 5 so as to allow re-installation of the wheel axle member 32 after which the lifting member 95 is returned to its stored position. Step 423, as illustrated in FIG. 2*j*, the structure 5 is unloaded from the transport trailer 88. In step 425, the structure 5 is placed adjacent the building 99, illustrated herein in FIG. 2*k* wherein the structure 10 is superposed upon a layout template 10 of the present invention. Step 427, the structure 5 is elevated utilizing the lifting member 95 wherein the floor 22 of the structure 5 is level with the floor 93 of the building 99. Step 427 is illustrated herein in FIG. 2*l*, and it should be understood within the scope of the present invention that the structure 5 may not need to be elevated to achieve the desired leveling of the floors as described herein. Step 429, as illustrated herein in FIG. 2*m*, the mounting posts 90 are installed, the lifting member 95 is removed as well as the wheel axle member 32 wherein the lifting member 95 and wheel axle member 32 are to be utilized in the method described herein for an additional structure 5. Step 429 will further include the final operable coupling of the utilities and any necessary crafting such as but not limited to door jamb and eave finishing. In step 431, the layout template 10 is inflated with foam or other suitable material as described herein.

Figure 3:
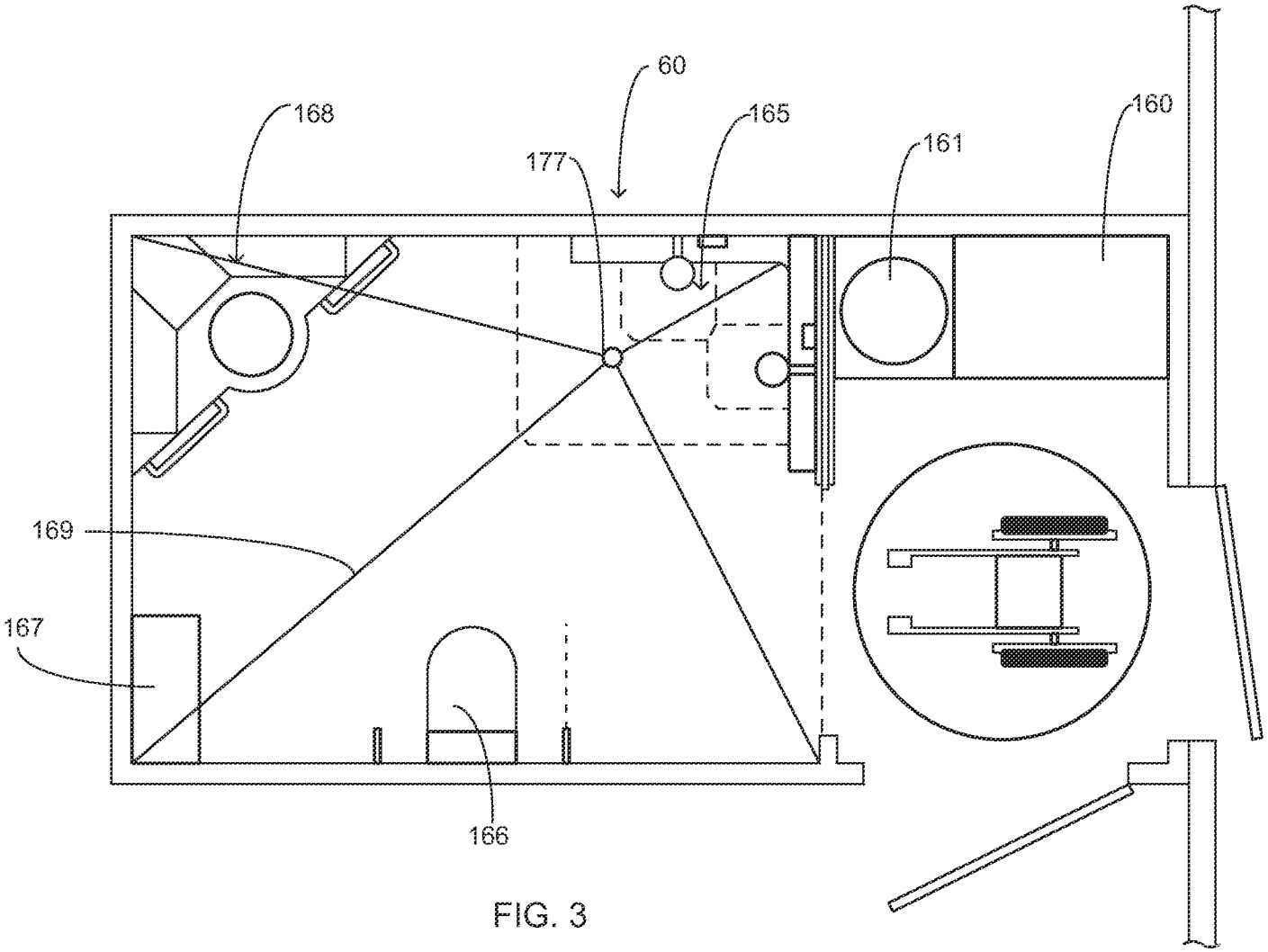
FIG. 3 is a schematic floor layout of the inside of the structure of the present invention.

Now referring herein to FIG. 3, an exemplary floor plan 60 of the structure 5 is illustrated therein. It should be understood within the scope of the present invention that the floor plan 60 is exemplary and it is contemplated that numerous alternate floor plans 60 could be provided in embodiments of the present invention. the exemplary floor plan 60 illustrated herein includes elements such as a counter top 160 with under counter water heater 161, a shower area 165 wherein the shower area 165 is level with the floor of the structure, a toilet 166, storage cabinet 167 and a sink area 168. Lines 169 indicate a camber of the floor towards drain 177. The floor plan 60 is designed to provide ergonomic and ease of use for individuals that require the use of a wheelchair.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A method of constructing and installing a modular structure wherein the method comprises the steps of:

providing a layout template, wherein the layout template is planar in manner and is substantially equivalent in size to the modular structure, said layout template having indicia instructions thereon operable to provide guidelines for preparing a site for installation of the modular structure, said layout template having an upper layer and a lower layer being operably coupled together, said layout template further including a plurality of inflation chambers, said inflation chambers being defined by a multitude of seams, said multitude of seams defining said inflation chambers configured to surroundably mount construction elements, wherein each inflation chamber includes a valve, said valve configured to permit introduction of a foam insulation;

preparing a floor of the modular structure, wherein a bottom surface of the floor is prepared with necessary elements to facilitate transportation of the modular structure;

constructing the modular structure, wherein the modular structure is built on an upper surface of the floor and wherein the constructing of the modular structure occurs at a first location;

transporting the modular structure, wherein the modular structure is loaded onto a transport trailer, the transport trailer being configured to be traversed to a second location;

placing the modular structure at the second location wherein the second location has been identified and prepared utilizing the layout template, wherein the modular structure is superposed upon the layout template;

installing the modular structure, wherein the modular structure is operably coupled to an existing building that is adjacent the second location;

coupling the modular structure to utilities, wherein the modular structure is operably coupled to utilities that are part of or present at the existing building in order to complete installation of the modular structure; and inflating the layout template, wherein each of the plurality of inflation chambers are inflated with a foam insulation.

2. The method of constructing and installing a modular structure as recited in claim 1, and further including the step of securing a lifting member to the bottom surface of the floor of the modular structure, wherein the lifting member is configured to traverse the modular structure in an upwards-downwards direction.

3. The method of constructing and installing a modular structure as recited in claim 2, and further including the step of securing a wheel axle member to the bottom surface of the floor of the modular structure, said wheel axle member operable to allow movement of the modular structure.

4. The method of constructing and installing a modular structure as recited in claim 3, and further including the step of leveling a portion of ground at the second location, wherein the portion of ground at the second location is generally equivalent in size to said lifting member.

5. The method of constructing and installing a modular structure as recited in claim 4, and further including the step of raising the modular structure, wherein the modular structure is elevated ensuing being loaded onto the transport trailer so as to remove the wheel axle member therefrom.

6. The method of constructing and installing a modular structure as recited in claim 5, and further including the step of elevating the modular structure at the second location, wherein the modular structure is elevated ensuing being placed adjacent to the existing building so as to align the floor of the modular structure to a floor of the existing building.

7. The method of constructing and installing a modular structure as recited in claim 6, wherein the modular structure is a bathroom configured to be accessible for a physically challenged individual.

8. A method of constructing and installing a modular structure wherein the modular structure is constructed at a first location and installed at a second location wherein the method comprises the steps of:

preparing the second location, wherein the second location is prepared and includes ground treatment and utility preparation, said second location being adjacent an existing building;

providing a layout template, wherein the layout template is planar in manner and is substantially equivalent in size to the modular structure, said layout template having indicia instructions thereon operable to provide guidelines for preparing a site for installation of the modular structure, said layout template having an upper layer and a lower layer being operably coupled together, said layout template further including a plurality of inflation chambers, said inflation chambers being defined by a multitude of seams, said multitude of seams defining inflation chambers configured to surroundably mount construction elements, wherein each inflation chamber includes a valve, said valve configured to permit introduction of a foam insulation;

preparing a floor of the modular structure, wherein a bottom surface of the floor is prepared with necessary elements to facilitate transportation of the modular structure, said floor having a defined surface area that is equivalent to that of a surface area of the layout template;

flipping the floor of the modular structure, wherein the floor is flipped so as to provide access to an upper surface thereof;

constructing the modular structure, wherein the modular structure is built on the upper surface of the floor and wherein the constructing of the modular structure occurs at the first location;

providing a transportation trailer, said transportation trailer being suitable in size to accommodate the modular structure thereon;

transporting the modular structure, wherein the modular structure is loaded onto the transport trailer, the transport trailer being configured to be traversed to a second location;

leveling a portion of the second location, wherein the portion of the second location is prepared so as to ensure a top surface thereof is level;

placing the modular structure at the second location wherein the second location has been identified and prepared utilizing the layout template;

installing the modular structure, wherein the modular structure is operably coupled to an existing building that is adjacent the second location;

coupling the modular structure to utilities, wherein the modular structure is operably coupled to utilities that are part of or present at the existing building in order to complete installation of the modular structure; and inflating the layout template, wherein each of the plurality of inflation chambers are inflated with a foam insulation.

9. The method of constructing and installing a modular structure as recited in claim 8, and further including the step of securing a wheel axle member to the bottom surface of the floor of the modular structure, said wheel axle member operable to allow movement of the modular structure.

10. The method of constructing and installing a modular structure as recited in claim 9, and further including the step of securing a lifting member to the bottom surface of the floor of the modular structure, said lifting member having a portion thereof that has an area that is approximately fifty percent of the surface area of the floor of the modular structure, wherein the lifting member is configured to traverse the modular structure in an upwards-downwards direction.

11. The method of constructing and installing a modular structure as recited in claim 10, and further including the step of lowering the modular structure onto the transportation trailer, wherein the lifting member is retracted so as to place the floor of the modular structure adjacent to an upper surface of the transport trailer.

12. The method of constructing and installing a modular structure as recited in claim 11, and further including the step of removing the wheel axle member from the floor of the modular structure, wherein the wheel axle member is removed ensuing installation of the modular structure at the second location.

13. The method of constructing and installing a modular structure as recited in claim 12, and further including the step of elevating the modular structure at the second location, wherein the modular structure is elevated utilizing the lifting member ensuing being placed adjacent to the existing building so as to align the floor of the modular structure to a floor of the existing building.

14. The method of constructing and installing a modular structure as recited in claim 13, and further including the step of securing mounting posts to the modular structure, wherein the mounting posts are operable to maintain the modular structure in the elevated position.

15. A method of constructing and installing a modular structure wherein the modular structure is constructed at a first location and installed at a second location wherein the method comprises the steps of:

preparing the second location, wherein the second location is prepared and includes ground treatment and utility preparation, said second location being adjacent an existing building;

providing a layout template, wherein the layout template is planar in manner and is substantially equivalent in size to the modular structure, said layout template having indicia instructions thereon operable to provide guidelines for preparing a site for installation of the modular structure, said layout template having an upper layer and a lower layer being operably coupled together, said layout template further including a plurality of inflation chambers, said inflation chambers being defined by a multitude of seams, said multitude of seams defining inflation chambers configured to surroundably mount construction elements, wherein each inflation chamber includes a valve, said valve configured to permit introduction of a foam insulation;

preparing a bottom surface of the floor of the modular structure, wherein a lifting member is secured to the bottom surface of the floor, wherein the lifting member includes a portion having a square footage that is approximately half of the square footage of the floor of the modular structure;

securing a wheel axle member to the bottom surface of the floor, said wheel axle member being proximate a second end of the floor of the modular structure;

flipping the floor of the modular structure, wherein the floor is flipped so as to provide access to an upper surface thereof;

constructing the modular structure, wherein the modular structure is built on the upper surface of the floor and wherein the constructing of the modular structure occurs at the first location;

providing a transportation trailer, said transportation trailer having an upper surface being suitable in size to accommodate the modular structure thereon;

moving the modular structure onto the transport trailer;

removing the wheel axle member from the bottom surface of the floor of the modular structure;

lowering the modular structure so as the floor thereof is adjacent the upper surface of the transportation trailer;

transporting the modular structure, wherein the modular structure is loaded onto a transport trailer, the transport trailer being configured to be traversed to a second location;

elevating the modular structure, wherein the modular structure is elevated from the upper surface of the transport trailer so as to provide access to re-install the wheel axle member;

leveling a portion of the second location, wherein the portion of the second location is prepared so as to ensure a tope surface thereof is level;

placing the modular structure at the second location wherein the second location has been identified and prepared utilizing the layout template;

installing the modular structure, wherein the modular structure is operably coupled to an existing building that is adjacent the second location;

coupling the modular structure to utilities, wherein the modular structure is operably coupled to utilities that are part of or present at the existing building in order to complete installation of the modular structure; and inflating the layout template, wherein each of the plurality of inflation chambers are inflated with a foam insulation.

16. The method of constructing and installing a modular structure as recited in claim 15, and further including the step of elevating the modular structure at the second location, wherein the modular structure is elevated utilizing the lifting member ensuing being placed adjacent to the existing building so as to align the floor of the modular structure to a floor of the existing building.

17. The method of constructing and installing a modular structure as recited in claim 16, and further including the step of securing mounting posts to the modular structure, wherein the mounting posts are operable to maintain the modular structure in the elevated position.

18. The method of constructing and installing a modular structure as recited in claim 17, and further including the step of removing the lifting member, wherein the lifting member is removed from the bottom surface of the floor of the modular structure.

19. The method of constructing and installing a modular structure as recited in claim 18, and further including the step of preparing a doorway, wherein a door way is prepared in the existing building so as to provide access to the second location.

20. The method of constructing and installing a modular structure as recited in claim 19, wherein the modular structure is a bathroom configured to be accessible for a physically challenged individual.

* * * * *